US010907242B2

(12) United States Patent
Fontaine

(10) Patent No.: US 10,907,242 B2
(45) Date of Patent: Feb. 2, 2021

(54) METHOD AND DEVICE FOR COATING A METAL STRIP WITH A COATING MATERIAL WHICH IS AT FIRST STILL LIQUID

(71) Applicant: FONTAINE ENGINEERING UND MASCHINEN GMBH, Langenfeld (DE)

(72) Inventor: Dominique Fontaine, Langenfeld (DE)

(73) Assignee: FONTAINE ENGINEERING UND MASCHINTEN GMBH, Langenfeld (DE)

( * ) Notice: Subject to any disclaimer, the term of this patent is extended or adjusted under 35 U.S.C. 154(b) by 98 days.

(21) Appl. No.: 16/110,027

(22) Filed: Aug. 23, 2018

(65) Prior Publication Data

US 2018/0363116 A1 Dec. 20, 2018

Related U.S. Application Data

(62) Division of application No. 15/528,572, filed as application No. PCT/EP2015/071859 on Oct. 2, 2015.

(30) Foreign Application Priority Data

Nov. 21, 2014 (DE) ..... 10 2014 223 818

(51) Int. Cl.

| | |
|---|---|
| ***C23C 2/00*** | (2006.01) |
| ***C23C 2/20*** | (2006.01) |
| ***C23C 2/06*** | (2006.01) |
| ***C23C 2/26*** | (2006.01) |

(52) U.S. Cl.
CPC ..... *C23C 2/003* (2013.01); *C23C 2/06* (2013.01); *C23C 2/20* (2013.01); *C23C 2/26* (2013.01)

(58) Field of Classification Search
CPC .. C23C 2/003; C23C 2/06; C23C 2/26; C23C 2/20
See application file for complete search history.

(56) References Cited

U.S. PATENT DOCUMENTS

| | | | |
|---|---|---|---|
| 4,135,006 | A | 1/1979 | Readal et al. |
| 6,471,153 | B1 | 10/2002 | Kimura et al. |
| 2004/0050323 | A1 | 3/2004 | Chae |

(Continued)

FOREIGN PATENT DOCUMENTS

| | | | |
|---|---|---|---|
| CA | 2 794 925 | A1 | 5/2011 |
| CN | 101376961 | A | 3/2009 |

(Continued)

OTHER PUBLICATIONS

International Search Report with English translation and Written Opinion dated Dec. 22, 2015 in corresponding application PCT/EP2015/071859; 12 pgs.

(Continued)

*Primary Examiner* — Hai Y Zhang
(74) *Attorney, Agent, or Firm* — Maier & Maier, PLLC

(57) ABSTRACT

A method and a device for coating a metal strip with a coating material which is at first still liquid. A first displacing device for displacing an electromagnetic stabilisation device relative to a blowing device in the plane transverse to the direction of transport of the metal strip is provided.

3 Claims, 2 Drawing Sheets

(56) References Cited

U.S. PATENT DOCUMENTS

| | | | | |
|---|---|---|---|---|
| 2008/0044584 | A1* | 2/2008 | Eriksson | C23C 2/003 427/430.1 |
| 2009/0175708 | A1 | 7/2009 | Lofgren et al. | |
| 2010/0209591 | A1* | 8/2010 | Eriksson | C23C 2/003 427/8 |
| 2013/0232811 | A1 | 9/2013 | Koga et al. | |

FOREIGN PATENT DOCUMENTS

| | | | |
|---|---|---|---|
| DE | 10 2008 039 244 | A1 | 3/2009 |
| DE | 10 2009 051 932 | A1 | 5/2011 |
| JP | 2003-113460 | A | 4/2003 |
| WO | 2006/006911 | A1 | 1/2006 |
| WO | 2009/024353 | A2 | 2/2009 |
| WO | 2012/172648 | A1 | 12/2012 |

OTHER PUBLICATIONS

Translation of the International Preliminary Report on Patentability dated May 26, 2017, in connection with corresponding international Application No. PCT/EP2015/071859; 7 pgs.

Office Action dated Jan. 11, 2019 in corresponding U.S. Appl. No. 15/528,572; 24 pages.

Office Action dated Sep. 5, 2018 in corresponding U.S. Appl. No. 15/528,572; 30 pages.

U.S. Office Action dated Sep. 9, 2019, in corresponding U.S. Appl. No. 15/528,572 (26 pgs.).

Office Action dated Sep. 30, 2018 in corresponding Chinese Application No. 201580063036.7; 17 pages including English-language translation.

Office Action dated Feb. 20, 2020 in corresponding U.S. Appl. No. 15/528,572; 16 pages.

Office Action issued on Sep. 18, 2020 in corresponding U.S. Appl. No. 15/528,572; 28 pages.

* cited by examiner

METHOD AND DEVICE FOR COATING A METAL STRIP WITH A COATING MATERIAL WHICH IS AT FIRST STILL LIQUID

CROSS-REFERENCE TO RELATED TO APPLICATIONS

This is a Divisional application of a non-provisional application having an application Ser. No. 15/528,572 filed on May 22, 2017, and a National Stage application of International Registration PCT/EP2015/071859 filed on Oct. 2, 2015, which claims priority to German Application No. 10 2014 223 818.8 filed on Nov. 21, 2014, the contents of which are all incorporated herein by reference.

FIELD

The invention relates to a method and a device for coating a metal strip with an initially still liquid coating material, for example zinc. The method and the device serve for, in particular, hot-dip galvanising of the metal strip.

BACKGROUND

Devices of that kind for coating a metal strip are basically known in the prior art thus, for example, from DE 10 2009 051 932 A1, WO 2009/024353 A2 and WO 2006/006911 A1. In concrete terms, these specifications disclose a coating container filled with a liquid coating material. For coating, the metal strip is passed through the container with the coating material. After leaving the coating container the metal strip runs through a blowing device, which is arranged above the coating container, for blowing excess parts of the still liquid coating material off the surface of the metal strip. An electromagnetic stabilising device for stabilising the metal strip after leaving the coating container and the blowing device is arranged above the blowing device and is supported by the blowing device. The electromagnetic stabilising device has the effect, in particular, that the strip is held centrally in a centre plane of the overall device and that oscillations of the metal strip during transit through the coating container and the blowing device are prevented or at least reduced. In WO 2009/024353 A2 the electromagnetic stabilising device is movable merely vertically with respect to the blowing device. In WO 2006/006911 A1 both devices are movable—synchronously due to a mechanical coupling—with respect to the metal strip.

Not only the blowing device, but also the electromagnetic stabilising device have a respective slot through which the metal strip is guided. In order to achieve a uniform thickness or thickness distribution of the coating material on the upper side and lower side of the metal strip it is essential for the metal strip to run in a predetermined target centre position through the slot of the blowing device. Only then is it guaranteed that the action of the blowing nozzles on the upper side and lower side of the metal strip is the same and a desired uniform thickness distribution of the coating material on the metal strip arises.

The target centre position is defined by, in particular, a preferably uniform spacing of the wide sides and the narrow sides of the metal strip from the opposite sides of the slot of the blowing device and, in particular, by the fact that the metal strip is neither inclined nor twisted relative to the longitudinal orientation of the slot.

However, due to disturbing influences it can happen that the metal strip moves out of the predetermined target centre position and thus its actual position deviates from the target centre position. Traditionally, a possible deviation of the actual position of the metal strip from the said target centre position is accordingly monitored by an operator or, as described in JP 2003-113460, by a sensor. In a given case the blowing device is then so displaced in a plane perpendicular to the transport direction of the metal strip that the metal strip is again guided in the predetermined target centre position in the slot of the blowing device. However, a displacement of that kind of the blowing device has the disadvantage that, as a result, the electromagnetic stabilising device is also correspondingly displaced therewith, because this electromagnetic stabilising device is traditionally—as described in, for example, DE 10 2008 039 244 A1—fixedly connected with the blowing device apart from a degree of freedom in vertical direction and is supported on this device. The electromagnetic stabilising device and the blowing device are also moved synchronously by the same amount in JP 2003-113460. The stated disturbance of the guidance of the metal strip through the slot of the blowing device does not, however, necessarily have an effect on the guidance of the metal strip through the slot of the electromagnetic stabilising device. Accordingly, the simultaneous displacement, which is described in DE 10 2008 039 244 A1 and JP 2003-113460, of the electromagnetic stabilising device together with the blowing device is in principle undesired, because this leads to an asymmetrical and thus undesired change in the action of force of the electromagnetic stabilising device on the metal strip.

SUMMARY

Starting from this prior art, the invention has the object of developing a known method and a known device for coating a metal strip in such a way that a desired displacement of the electromagnetic stabilising device is prevented in the case of displacement of the blowing device.

In terms of method this object is fulfilled by the method claimed in claim 1.

The electromagnetic stabilising device is also termed Dynamic Electro Magnetic Coating Optimizer DEMCO by the Applicant.

Through the claimed relative movement of the electromagnetic stabilising device with respect to the blowing device in opposite direction it is made possible and ensured that a displacement of the blowing device does not necessarily lead to an undesired displacement of the electromagnetic stabilising device. In concrete terms, the metal strip can, in particular, be kept in the slot of the electromagnetic stabilising device, preferably in a target centre position, even if the blowing device moves in a plane transverse to the transport direction of the metal strip. For this purpose, the electromagnetic stabilising device is moved relative to the blowing device in precisely the opposite direction to the blowing device (compensation). Advantageously, through this method step correct functioning of the electromagnetic stabilising device is ensured even when the blowing device has to be displaced for reinstating guidance of the metal strip in the target centre position through the slot of the blowing device.

According to the invention, deviation of the actual position of the metal strip from a predetermined target centre position in the slot of the blowing device is detected and the actual position of the metal strip is regulated to the predetermined target centre position by suitable displacement of the blowing device in a plane transverse to the transport direction of the metal strip.

According to the invention, detection of the displacement of the blowing device takes place relative to a pass line reference position. The pass line reference position is then defined by the constructional installation centre as defined by, in particular, the fixed position of a first deflecting roller for the metal strip within the coating container and the fixed position of a second deflecting roller above the stabilising device.

The detected deviation of the actual position of the metal strip from its target centre position in the slot of the electromagnetic stabilising device or the blowing device can be either a translational shifting parallel to a longitudinal direction defined by the target centre position or a rotation relative to the predetermined target centre position. These two forms of deviation of the actual position from the target centre position of the metal strip or a corresponding shifting or rotation of the electromagnetic stabilising device are also termed skew function by the Applicant.

Alternatively, the detected deviation of the actual position of the metal strip is a translational shifting in width direction x (relative) to the predetermined target centre position of the metal strip in the slot of the electromagnetic stabilising device or blowing device. A deviation of that kind of the actual position from the target centre position of the metal strip or a corresponding shifting of the electromagnetic stabilising device is also termed scan function by the Applicant.

In a particularly advantageous embodiment the device comprises a human machine interface (HMI) for an operator of the device for visualisation of, for example, the detected deviation of the actual position of the metal strip from the target centre position in the slot of the blowing device or in the slot of the electromagnetic stabilising device or for visualisation of the detected deviation of the blowing device from the pass line reference position or for visualisation of the change in the stated deviations over time. Performance of the method is substantially simplified by visualisation of that kind of the deviations or the changes in time thereof.

BRIEF DESCRIPTION OF THE DRAWINGS

Accompanying the invention are three figures, in which.

DETAILED DESCRIPTION

Figure 1:
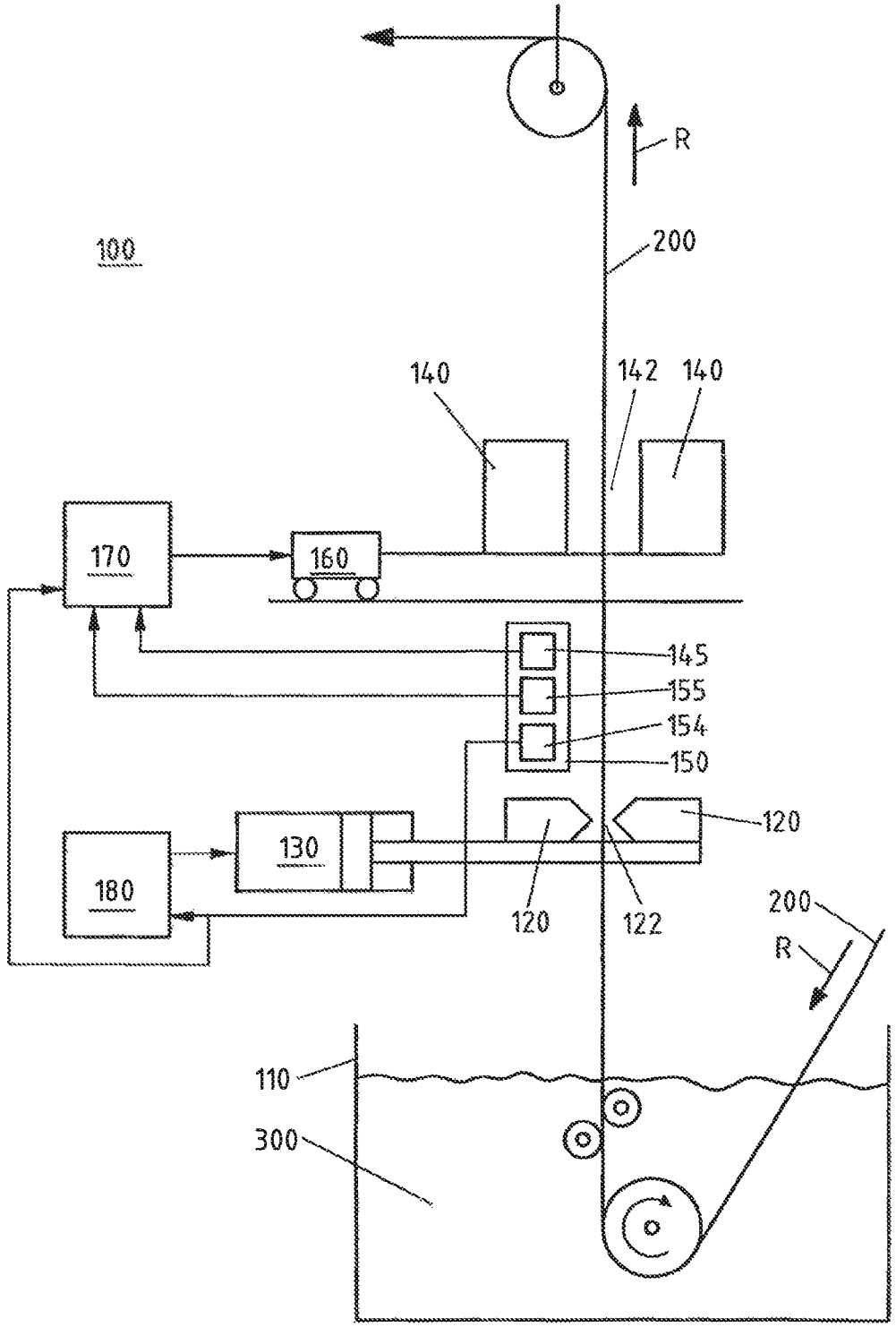
FIG. 1 shows the device according to the invention.

The invention is described in detail in the following in the form of embodiments with reference to the mentioned figures. The same technical elements are denoted by the same reference numerals in all figures.

FIG. 1 shows the device 100 according to the invention for coating a metal strip 200 with a liquid coating material 300, for example zinc. For this purpose, the initially still uncoated metal strip 200 is conducted in transport direction R in a coating container 110 filled with the liquid coating material. Within the coating container 110 the metal strip 200 is deflected with the help of a deflecting roller so that it leaves the coating container at the top. After the transit through the coating container, the still liquid coating material adheres to the metal strip 200.

Arranged above the coating container 110 is a blowing device 120 which spans a slot 122 through which the metal strip 200 is guided. Excess coating material is blown off the surface of the metal strip 200 with the help of the blowing device.

Figure 2:
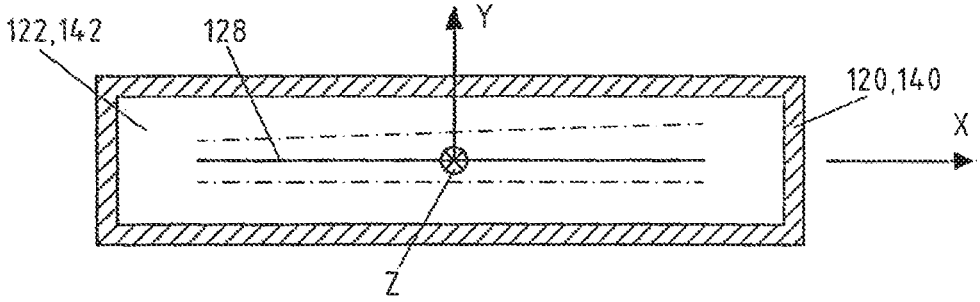
FIGS. 2 and 3 show plan views of the slot of the blowing device according to the invention or the electromagnetic stabilising device according to the invention each with marking of the target centre position and different desired actual positions of the metal strip.

In order that blowing onto the upper side and lower side of the metal strip 200 takes place uniformly it is important that the metal strip 200 runs through the slot 122 of the blowing device 120 in a predetermined target centre position 128, as symbolised in FIG. 2 in the form of the solid line in X direction. This target centre position is distinguished by, in particular, uniform spacings or spacing distributions from the inner edges of the slot 122 of the blowing device 120. Possible undesired actual positions of the metal strip are also drawn, as dashed lines, in FIG. 2 near the desired predetermined target centre position. Undesired actual positions for the metal strip are thus present, for example, if it is twisted relative to the target centre position or shifted parallelly in Y direction.

Figure 3:
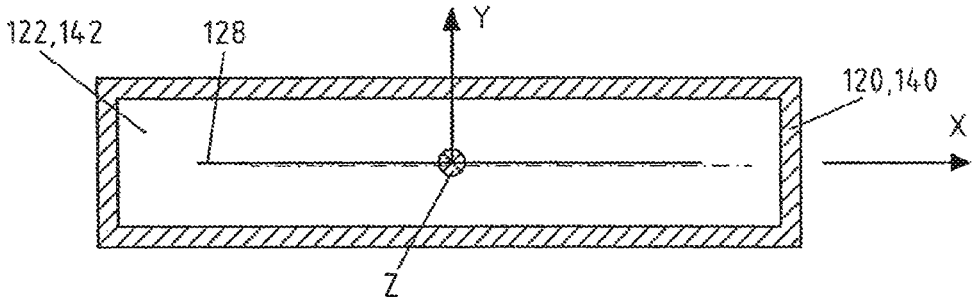

FIG. 3 shows a third possible undesired actual position, in which the metal strip 200 is parallelly shifted in X direction, i.e. in width direction, relative to the target centre position.

With further reference to FIG. 1 there can be seen above the blowing device 120 an electromagnetic stabilising device 140 which in turn has a slot 142 through which the metal strip 200 is similarly guided. It is also the case here that the metal strip 200 runs through the slot 142 preferably in a predetermined target centre position 128, as shown in FIGS. 2 and 3, so that the forces provided by the electromagnetic stabilising device 140 can have a stabilising action in desired manner uniformly on the metal strip 200. The same applies to the slot 142 and the centre position, which is also desired thereat, as beforehand with reference to FIGS. 2 and 3 for the slot 122 of the blowing device 120.

The electromagnetic stabilising device 140 is mechanically supported on the blowing device 120. However, according to the invention this support is not carried out rigidly, but by way of a first displacing device 160 provided between the blowing device 120 and the electromagnetic stabilising device 140. In concrete terms, the first displacing device 160 enables displacement of the electromagnetic stabilising device 140 relative to the blowing device in a plane transverse to the transport direction R of the metal strip. The displacing device 160 is controlled with the help of a control device 170.

In addition, a first detecting device 154 for detecting a deviation of the actual position of the metal strip 200 from a predetermined target centre position in the slot 122 of the blowing device 120 is arranged between the stabilising device 140 and the blowing device 120. Alternatively, the first detecting device 154 can also be constructed only for detection of the actual position of the metal strip. Moreover, a regulating device 180 is provided for regulating the actual position of the metal strip 200 to a predetermined target centre position in the slot 122 of the blowing device, as explained above with reference to FIGS. 2 and 3, through displacement of the blowing device 120 with the help of a second blowing device 130. The regulation is carried out in response to the detected deviation. If determination of the deviation of the actual position from the target centre position does not take place in the first detecting device 154, it can also be undertaken, for example, within the regulating device 180. The displacement is carried out in a plane transverse to the transport direction R of the metal strip as a function of the detected deviation of the actual position of the metal strip from the predetermined target centre position in the slot 122 of the blowing device. In other words, if it is ascertained that the metal strip 200 does not run through the slot 122 in the target centre position 128, then the blowing device 120 is so displaced with the help of the second displacing device 130 that the metal strip again runs through the slot 122 of the blowing device in the predetermined target centre position 128. For that purpose, the first detecting device 154 is constructed so that it can preferably detect all three actual positions of the metal strip 200 deviating from the target centre position 128 as described above with reference to FIGS. 2 and 3.

The said displacement of the blowing device 120 does not have to have an effect on the electromagnetic stabilising device 140, which is supported on the blowing device 120. For that purpose, the control device 170 is constructed to control the first displacing device 160 in such a way that the electromagnetic stabilising device 140 in the case of a displacement of the blowing device 120 relative to a pass line reference position is not moved therewith, but can remain at its original location. The control device 170 accordingly acts in such a way on the first displacing device 160 that in the case of a displacement of the blowing device 120 the electrical stabilising device 140 preferably makes precisely the opposite movement to the blowing device 120, i.e. as a result preferably remains at its original location.

In order to realise this special form of control for the first displacing device 160 the control device 170 can evaluate different situations. On the one hand, the control device 170 can be constructed to perform displacement of the electromagnetic stabilising device 140 as a function of the deviation, which is detected by the first detecting device 154, of the actual position of the metal strip from the predetermined target centre position of the metal strip in the slot 122 of the blowing device 120.

Alternatively or additionally, the control device 170 can be constructed to perform the displacement of the electromagnetic stabilising device as a function of and in opposite direction to the displacement, which is detected by a second detecting device 155, of the blowing device 120.

Finally, according to a further alternative or additionally the control device 170 can be constructed to cause displacement of the electromagnetic stabilising device 140 as a function of a detected deviation of the actual position of the metal strip from a predetermined target centre position in the slot 142 of the electromagnetic stabilising device. A precondition for that is that a third detecting device 145 is present for detecting the said deviation of the actual position of the metal strip from the predetermined target centre position in the slot 142 of the electromagnetic stabilising device 140.

The first, second and third detecting devices 154, 155, 145 are constructed to preferably recognise all conceivable deviations of an actual position of the metal strip from the desired target centre position. Amongst those is, in particular, a (parallel) shifting of the metal strip in X or Y direction or a rotation such as explained above with reference to FIGS. 2 and 3. Accordingly, the first and second displacing devices 130, 160—in the case of suitable control by the regulating device 180 or the control device 170—are constructed to move the blowing device 120 and the electromagnetic stabilising device 140 in a desired manner in a plane transverse to the transport direction R of the metal strip, particularly to shift (parallelly) or to rotate so as to realise running-through of the metal strip in the target centre position. To that extent, the illustration of the first and second displacing devices 160, 130 as a carriage or piston-cylinder unit is in each instance merely exemplifying, but not limiting.

The first and third detecting devices 154, 145 as well as optionally also the second detecting device 155 can be realised in the form of a single sensor device 150, which, for example, is constructed in confocal manner or is laser assisted. To that extent, the sensor device—also termed 'laser' for short—forms a constructional unit for the mentioned detecting devices. The sensor device 150 can also be generally termed spacing detection device.

REFERENCE NUMERAL LIST

100 device
110 coating container
120 blowing device
122 slot of the blowing device
128 target centre position of the metal strip in the blowing device or the electromagnetic stabilising device
130 second displacing device
140 electromagnetic stabilising device
142 slot of the electromagnetic stabilising device
145 third detecting device
150 sensor device
154 first detecting device
155 second detecting device
160 first displacing device
170 control device
180 regulating device
200 metal strip
300 coating material
R transport direction of the metal strip
X width direction of the metal strip in target centre position
Y direction transverse to the plane spanned by the metal strip

The invention claimed is:

1. A method of coating a metal strip with an initially still liquid coating material, comprising:

passing the metal strip to be coated through a coating container filled with the liquid coating material;

blowing excess parts of the still liquid coating material off the surface of the metal strip with the help of a blowing device after passage through the coating container;

stabilising the metal strip, after leaving the blowing device, with the help of an electromagnetic stabilising device which is arranged downstream of the blowing device in the transport direction of the metal strip and which is supported on the blowing device;

regulating the actual position of the metal strip to the predetermined target centre position by suitable displacement of the blowing device in a plane transverse to the transport direction of the metal strip;

displacing the electromagnetic stabilising device relative to the blowing device in a plane transverse to the transport direction of the metal strip so that the actual position of the metal strip at least approximately corresponds with a predetermined target centre position in the slot of the electromagnetic stabilising device; and wherein deviation of the actual position of the metal strip from a predetermined target centre position in the slot of the blowing device is detected;

the displacement of the blowing device is directly or indirectly detected relative to a pass line reference position; and the displacement of the electromagnetic stabilising device is carried out as a function of and in opposite direction to the detected displacement of the blowing device so that as a result the electromagnetic stabilising device remains at its original location.

2. The method according to claim 1, wherein the detected deviation of the actual position of the metal strip in the slot of the electromagnetic stabilising device or the blowing device is a translational shifting parallel to a longitudinal direction defined by the target centre position and a rotation relative to the predetermined target centre position of the metal strip in the slot of the electromagnetic stabilising device or the blowing device.

3. The method according to claim 1, wherein the detected deviation of the actual position of the metal strip is a translational shifting in width direction (x) relative to the predetermined target centre position of the metal strip in the slot of the electromagnetic stabilising device or the blowing device.

* * * * *